US007556515B2

(12) United States Patent
Kato et al.

(10) Patent No.: US 7,556,515 B2
(45) Date of Patent: Jul. 7, 2009

(54) CONNECTOR IMPROVED IN HANDLABILITY OF A CONNECTION OBJECT AND BACKLIGHT ASSEMBLY USING THE CONNECTOR

(75) Inventors: Rintaro Kato, Tokyo (JP); Nobukazu Kato, Tokyo (JP); Akira Kimura, Tokyo (JP); Masakazu Kuroiwa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/001,354

(22) Filed: Dec. 11, 2007

(65) Prior Publication Data

US 2008/0146060 A1 Jun. 19, 2008

(30) Foreign Application Priority Data

Dec. 15, 2006 (JP) ..... 2006-338885
Jan. 19, 2007 (JP) ..... 2007-010513

(51) Int. Cl.
*H01R 29/00* (2006.01)

(52) U.S. Cl. ..... 439/171; 439/474; 439/619; 439/857

(58) Field of Classification Search ..... 439/171, 439/474, 619, 699.1, 699.2, 857
See application file for complete search history.

(56) References Cited

U.S. PATENT DOCUMENTS 6,905,224 B2 * 6/2005 Yoo et al. ..... 362/225
2004/0142605 A1 * 7/2004 Harada et al. ..... 439/857

FOREIGN PATENT DOCUMENTS

JP 2002367422 12/2002
JP 2003257570 9/2003

* cited by examiner

*Primary Examiner*—Tho D Ta
*Assistant Examiner*—Travis Chambers
(74) *Attorney, Agent, or Firm*—Collard & Roe, P.C.

(57) ABSTRACT

In a connector including a conductive member adapted to be connected to a connection object, the conductive member includes a movable contacting portion to be contacted with the connection object and a position control portion integrally formed with the contacting portion and serving to control a position of the contacting portion. The contact may includes a main body integrally formed with the contacting portion and an elastic portion coupling the position control portion to the main body so that the position control portion is displaceable with respect to the main body. The main body may be integrally formed with the position control portion. The elastic portion may couple the contacting portion to the main body so that the contacting portion is displaceable with respect to the main body.

7 Claims, 8 Drawing Sheets

CONNECTOR IMPROVED IN HANDLABILITY OF A CONNECTION OBJECT AND BACKLIGHT ASSEMBLY USING THE CONNECTOR

This application claims priority to prior Japanese patent applications JP 2006-338885 and JP 2007-10513, the disclosures of which are incorporated herein by reference.

BACKGROUND OF THE INVENTION

This invention relates to a connector, such as a direct type lamp socket, adapted to connect a lamp tube and to a backlight assembly using the connector.

Recently, a large-sized liquid crystal display is widely used in various technical fields. A backlight module used in the large-sized liquid crystal display comprises a small-diameter lamp tube, such as CCFL (cold cathode fluorescent lamp) and EEFL (external electrode fluorescent lamp), as a light source. A system in which a liquid crystal glass is irradiated directly by a light from the lamp tube located behind the liquid crystal glass is called a direct type. The direct-type system is excellent in light utilization efficiency and is most suitable for a backlight of a liquid crystal display, such as a monitor and a television, requiring a high brightness.

For a conventional direct-type backlight module, several systems are known.

In a first system, a backlight module comprises a metal casing called a chassis and a plurality of lamp tubes arranged on one surface of the chassis and spaced from one another. Each lamp tube has lead wires as electrode portions at opposite ends thereof. The lead wires are connected to one ends of cables by soldering, respectively. One end of each electrode portion connected to each cable by soldering is coated with a rubber member. The cable extracted from the rubber member has the other end to which a terminal is crimped. The terminal is received in a connector housing and is connected to a connector mounted to an inverter substrate disposed on the other surface of the chassis. Thus, the lamp tube is supplied with electric power through the connector and the cable.

In another system, a connector comprising an insulator, a terminal portion, and a slider member is mounted to an inverter substrate. The connector extends through a chassis to a lamp tube mount surface. An electrode portion of a lamp tube is directly connected to the terminal of the connector. In this system, after the lamp tube is incorporated into the terminal portion of the connector, the slider member is operated to connect a lead wire of the lamp tube and a contact. After the lead wire and the contact are connected to each other, the lead wire is relatively firmly fixed.

However, in the system in which the lamp tube is supplied with electric power through the cable, the lamp tube is connected to the inverter substrate through the rubber member, the cable, and the connector. Therefore, a large number of components are used and a large number of operation steps is required. Further, upon exchanging a fluorescent tube, other components must be exchanged together. This brings about an increase in cost. In addition, the lamp tube with the cable soldered thereto is easily broken during handling.

In the system in which the connector is mounted onto the inverter substrate and the lamp tube is directly connected thereto, it is possible to achieve reduction in number of components and easy attachment/detachment of the lamp tube. However, various kinds of stresses are caused to occur, for example, a stress generated during contact due to a positioning error at assembling of the lamp tube and the connector, a stress of vibration or mechanical shock applied during transportation or during use of a liquid crystal assembly, or a stress due to heat shrinkage of the lamp tube resulting from heat generation of the lamp tube itself. These stresses concentrate to the lead wire of the lamp tube or a lead wire sealing portion and may result in breakage of the lamp tube or a shortened lifetime of the lamp tube.

A socket for connecting a typical lamp is disclosed, for example, in Japanese Unexamined Patent Application Publication (JP-A) No. 2003-257570. A socket for connecting a fluorescent tube is disclosed, for example, in Japanese Unexamined Patent Application Publication (JP-A) No. 2002-367422. However, the techniques disclosed in these publications can not solve the above-mentioned problems.

A backlight assembly and a lamp holder are disclosed in, for example, Japanese Unexamined Patent Application Publication (JP-A) No. 2002-367422 and Japanese Unexamined Patent Application Publication (JP-A) No. 2003-257570, respectively. However, these techniques are disadvantageous in that a large number of components and a high cost are required.

SUMMARY OF THE INVENTION

It is therefore an exemplary object of this invention to provide a connector which is improved in handlability of a connection object and which makes it easy to connect and disconnect the connection object.

It is another exemplary object of this invention to provide a connector which is improved in handlability of a lamp tube and which makes it easy to connect and disconnect the lamp tube.

It is still another exemplary object of this invention to provide a backlight assembly which requires a small number of components so that the number of assembling steps is reduced and the cost is lowered.

Other objects of the present invention will become clear as the description proceeds.

According to an exemplary aspect of the present invention, there is provided a connector comprising a conductive member adapted to be connected to a connection object, the conductive member comprising a movable contacting portion to be contacted with the connection object and a position control portion integrally formed with the contacting portion and serving to control a position of the contacting portion.

DESCRIPTION OF THE EXEMPLARY EMBODIMENTS

Figure 1A:
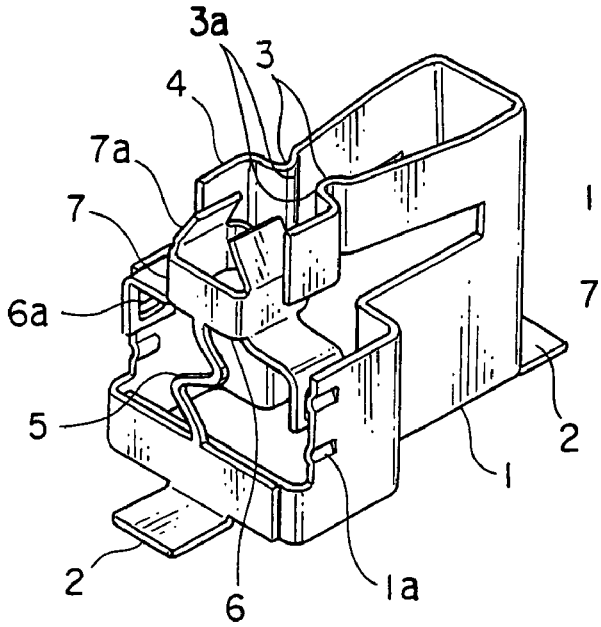
FIG. 1A is a perspective view of a connector according to a first exemplary embodiment of this invention in an opened state.

Referring to FIGS. 1A to 1D, description will be made of a connector according to a first exemplary embodiment of this invention.

The connector illustrated in FIGS. 1A to 1D is formed by a conductive member or plate such as a metal plate or the like and, therefore, corresponds to a contact known in the art. Accordingly, the connector may be called a contact.

The connector has a main body 1 provided with a pair of terminal portions 2 formed at opposite ends of a lower part thereof and adapted to be connected to a substrate or the like. The main body 1 has a pair of contacting portions 3 formed at its upper part and extending from one end towards a center area. The contacting portions 3 are movable and are adapted to be contacted with a connection object (for example, a conductor wire of a lamp or the like). The contacting portions 3 have a pair of contacting surfaces 3*a* faced to each other, respectively, and a pair of abutting portions 4 formed at their ends, respectively.

The main body 1 has an elastic portion 5 formed at the other end. The elastic portion 5 is provided with a slider portion (actuator) 6. Thus, the elastic portion 5 connects the slider portion 6 to the main body 1 so that the slider portion 6 is displaceable with respect to the main body 1.

The slider portion 6 has an operating portion 7 serving as a position control portion for controlling a position of the contacting portions 3. The operating portion 7 has a press-widening portion 7*a* comprising a pair of tongue-shaped parts formed at its end. The widening portion 7*a* is adapted to be inserted into and released from the abutting portions 4. The tongue-shaped parts forming the press-widening portion 7*a* are inclined so as to approach each other towards an upper end.

The slider portion 6 has a pair of holes 6*a* formed at opposite sides of its lower part and serving as engaged portions. In correspondence to each of the holes 6*a*, the main body 1 has a pair of upper and lower protrusions 1*a* serving as engaging portions.

Figure 1B:
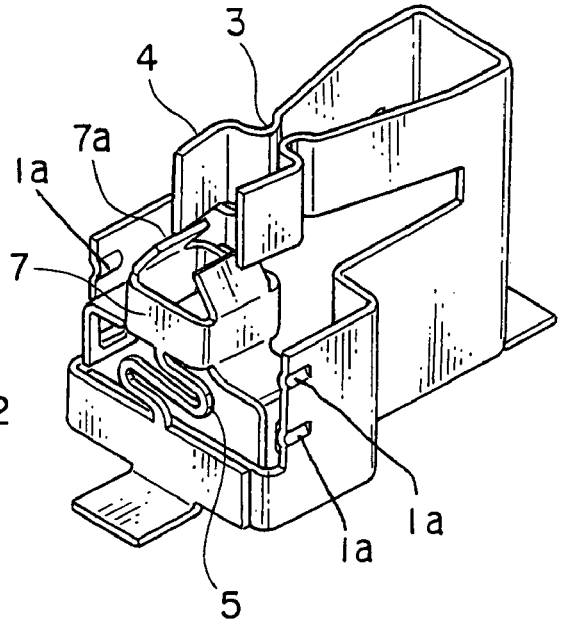
FIG. 1B is a perspective view of the connector in FIG. 1A in a closed state.
Figure 1C:
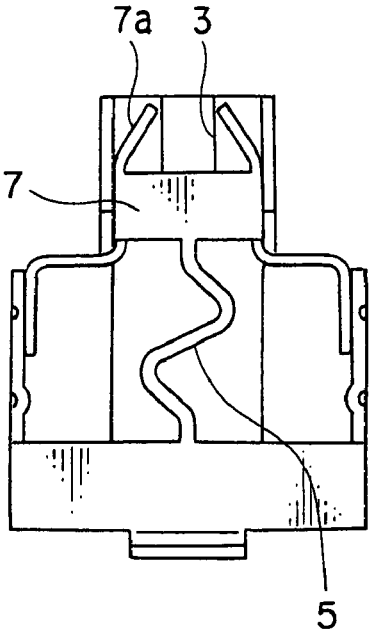
FIG. 1C is a front view of the connector in FIG. 1A in the opened state.

In the state illustrated in FIGS. 1A and 1C, the operating portion 7 is located at an operative or active position and the press-widening portion 7*a* is inserted between the abutting portions 4. Therefore, the contacting portions 3 are widened and separated from each other. The holes 6*a* of the slider portion 6 are engaged with the upper ones of the protrusions 1*a* of the main body 1 so that the contacting portions 3 are kept in an opened state. Therefore, the connection object is allowed to be inserted between the contacting portions 3. In this state, the connection object is inserted between the contacting portions 3 with zero insertion force or low insertion force. Thereafter, the slider portion 6 is pushed downward. Then, the operating portion 7 is moved to an inoperative or inactive position and the press-widening portion 7*a* is released from a space between the abutting portions 4.

Figure 1D:
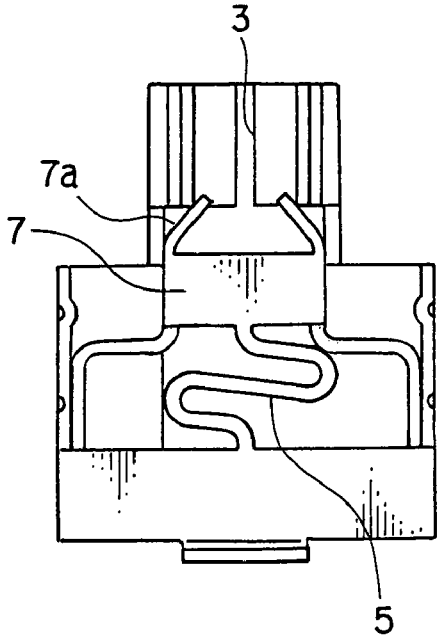
FIG. 1D is a front view of the connector in FIG. 1A in the closed state.

Then, as illustrated in FIGS. 1B and 1D, the contacting portions 3 are moved towards each other by inherent elasticity to be put into a closed state. Therefore, the contacting surfaces 3*a* are brought into contact with the connection object to clamp the connection objects on opposite sides. At this time, the elastic portion 5 is compressed and deformed. The holes 6*a* of the slider portion 6 are engaged with the lower ones of the protrusions 1*a* of the main body 1 so that the contacting portions 3 are kept in the closed state.

The foregoing embodiment may be modified in design so that the holes 6*a* and the protrusions 1*a* are formed on the main body 1 and the slider portion 6, respectively. The holes 6*a* may be replaced by recesses or grooves.

Figure 2A:
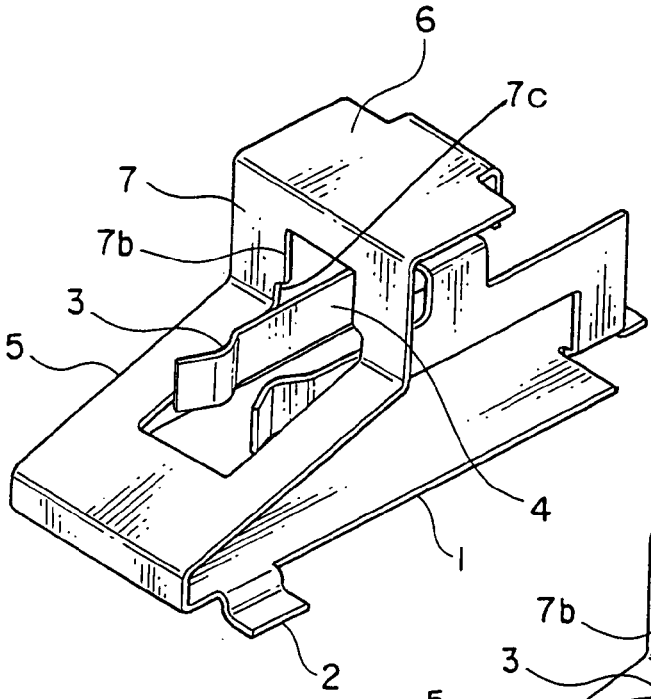
FIG. 2A is a front perspective view of a connector according to a second exemplary embodiment of this invention in an opened state.
Figure 2B:
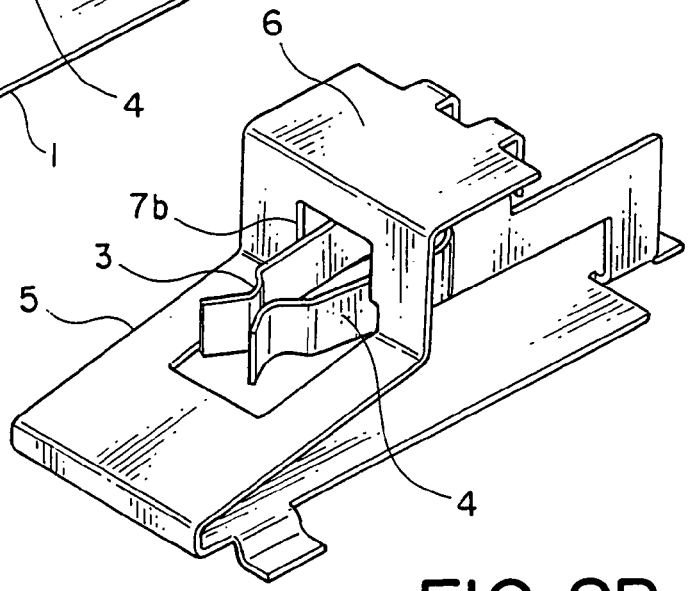
FIG. 2B is a front perspective view of the connector in FIG. 2A in a closed state.
Figure 2C:
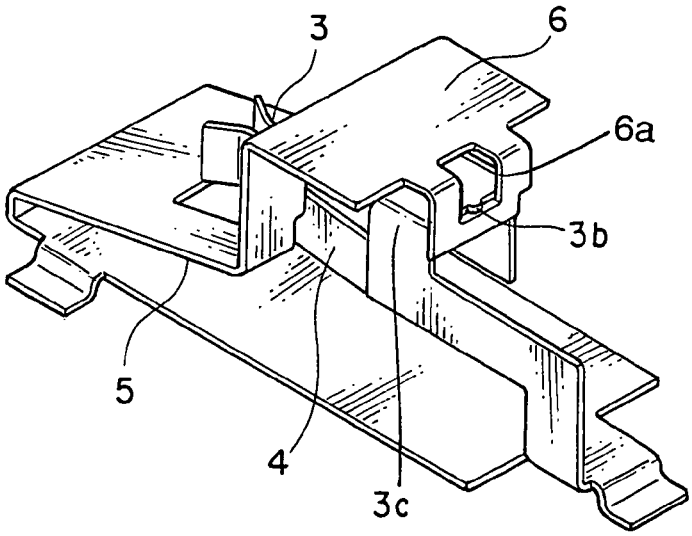
FIG. 2C is a rear perspective view of the connector in FIG. 2A in the closed state.

Referring to FIGS. 2A to 2C, description will be made of a connector according to a second exemplary embodiment of this invention. Similar parts are designated by like reference numerals and description thereof will be omitted.

In the connector illustrated in FIGS. 2A to 2C, a positional relationship between the contacting portions 3 and the abutting portions 4 are reverse to that between the contacting portions 3 and the abutting portions 4 of the connector illustrated in FIGS. 1A to 1D. The press-widening portion 7*a* of the connector in FIGS. 1A to 1D is replaced by a press-narrowing portion 7*b* reversed in function.

In the state illustrated in FIG. 2A, the operating portion 7 is in the inoperative position and the contacting portions 3 are kept in the opened state. Therefore, the connection object can be inserted between the contacting portions 3. The press-narrowing portions 7*b* have a pair of guide portions 7*c* which serve to smoothly insert the press-narrowing portions 7*b* between the abutting portions 4.

In the state illustrated in FIG. 2B, the operating portion 7 is moved to an operative position so that the contacting portions 3 are brought into the closed state. Therefore, the contacting portions 3 are press-contacted against the connection object inserted therebetween.

Further, as illustrated in FIG. 2C, the engaged portions (openings) 6*a* formed on the slider portion 6 are engaged with engaging portions (protrusions) 3*b* formed on a coupling portion 3*c* coupling the contacting portions 3 to each other. Thus, the contacting portions 3 are kept in the closed state.

Figure 3A:
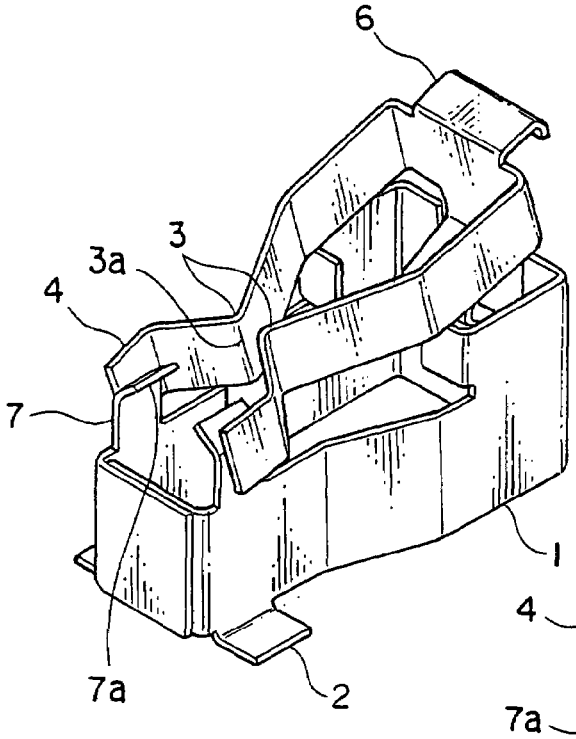
FIG. 3A is a front perspective view of a connector according to a third exemplary embodiment of this invention in an opened state.
Figure 3B:
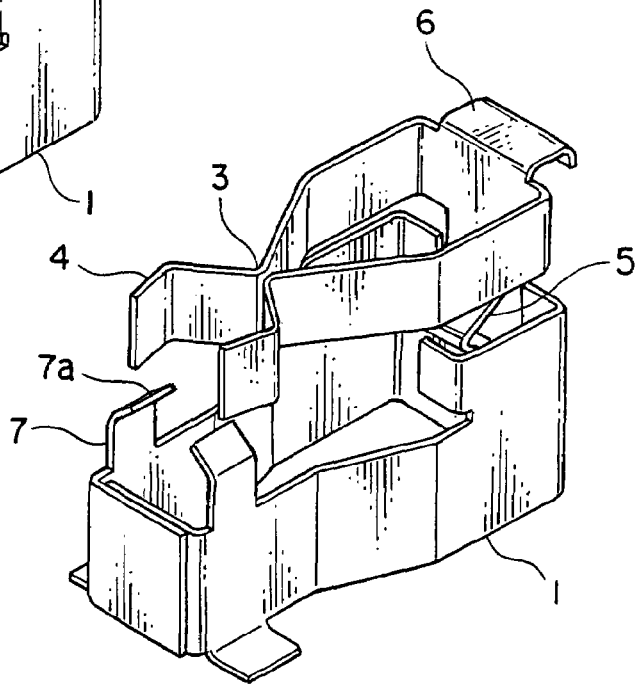
FIG. 3B is a front perspective view of the connector in FIG. 3A in a closed state.
Figure 3C:
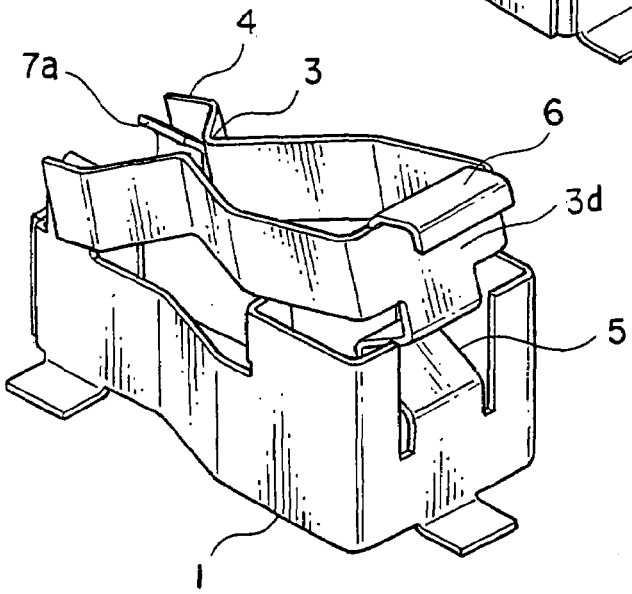
FIG. 3C is a rear perspective view of the connector in FIG. 3A in the opened state.

Referring to FIGS. 3A to 3C, description will be made of a connector according to a third exemplary embodiment of this invention. Similar parts are designated by like reference numerals and description thereof will be omitted.

In the connector illustrated in FIGS. 3A to 3C, the elastic portion 5 and the slider portion (actuator) 6 are formed at one end of the main body 1. The elastic portion 5 and the slider portion (actuator) 6 are formed on the coupling portion 3*d* coupling the contacting portions 3 to each other.

As illustrated in FIGS. 3A and 3C, the slider portion (actuator) 6 is operated to engage the abutting portions 4 and the operating portion 7 with each other so that the contacting portions 3 are kept in the opened state. Therefore, the connection object is allowed to be inserted between the contacting portions 3.

When the operation of the slider portion (actuator) 6 is cancelled, the abutting portions 4 are separated from the operating portion 7 as shown in FIG. 3B due to restoring force of the elastic portion 5. Consequently, the contacting portions 3 are put into the closed state. Therefore, the contacting portions 3 are press contacted with the connection object.

Figure 4A:
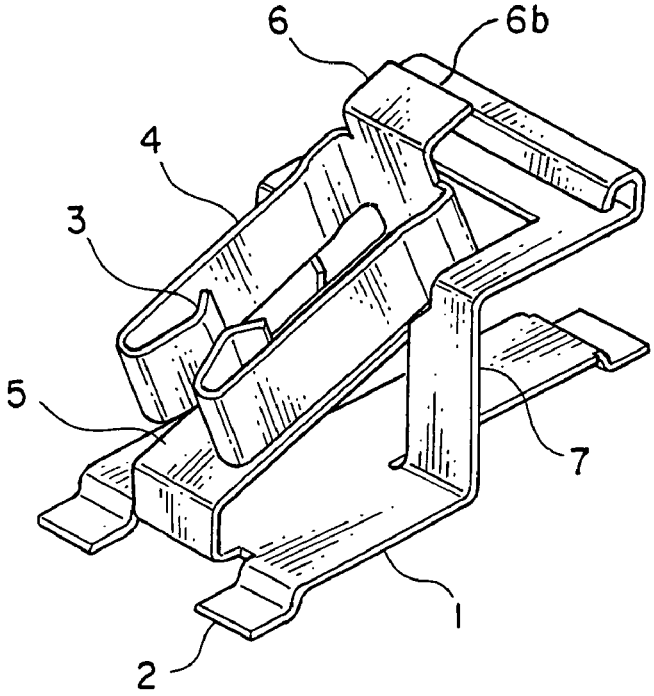
FIG. 4A is a front perspective view of a connector according to a fourth exemplary embodiment of this invention in an opened state.
Figure 4B:
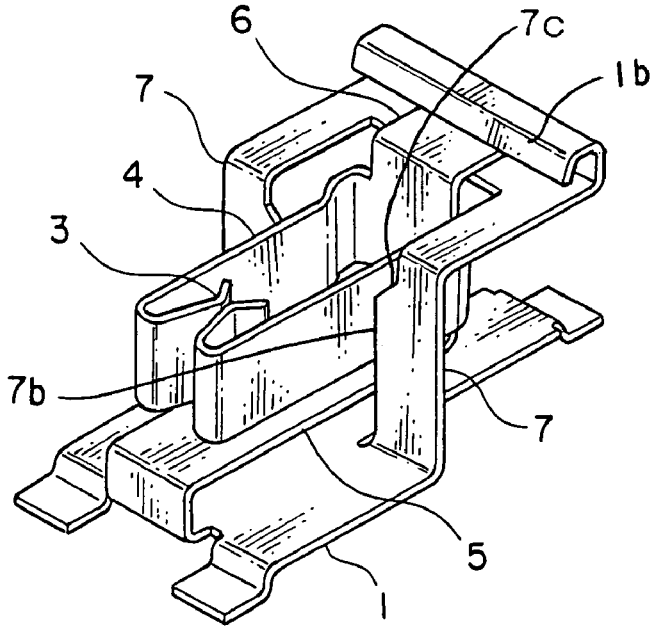
FIG. 4B is a front perspective view of the connector in FIG. 4A in a closed state.

Referring to FIGS. 4A and 4B, description will be made of a connector according to a fourth exemplary embodiment of this invention. Similar parts are designated by like reference numerals and description thereof will be omitted.

In the connector illustrated in FIGS. 4A and 4B, the connection object is connected in a manner similar to the connector illustrated in FIGS. 2A to 2C. Each contacting portion 3 is coupled to the elastic portion 5 via each corresponding abutting portion 4. The operating portions 7 are formed on the main body 1.

Normally, as illustrated in FIG. 4A, the contacting portions 3 are kept in the opened state. After the connection object is located at a predetermined position, the slider portion 6 is pushed downward. Then, as illustrated in FIG. 4B, the contacting portions 3 are closed by the operating portions 7. An end portion 6*b* of the slider portion 6 is engaged with an engaging portion 1*b* of the main body 1 so that the contacting portions 3 are kept in the closed state to be contacted with the connection object. In the state where the abutting portions 4 are pressed, the contacting portions 3 are kept in contact with the connection object.

Figure 5:
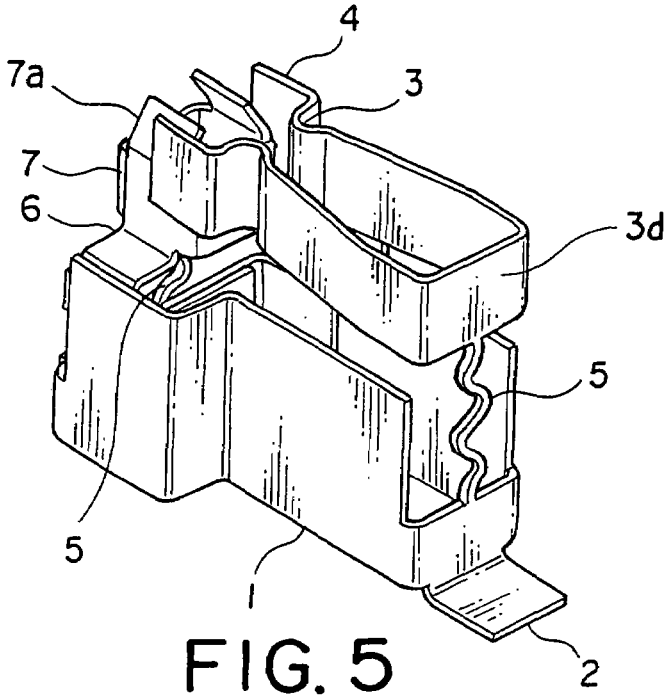
FIG. 5 is a rear perspective view of a connector according to a fifth exemplary embodiment of this invention in an opened state.

Referring to FIG. 5, description will be made of a connector according to a fifth exemplary embodiment of this invention. Similar parts are designated by like reference numerals and description thereof will be omitted.

In the connector illustrated in FIG. 5, the elastic portion 5 is provided between the slider portion 6 and the main body 1. Similarly, the elastic portion 5 is provided between the contacting portions 3 and the main body 1. Since the coupling portion 3*d* is connected to the elastic portion 5, the contacting portions 3 are kept in a floating state.

Figure 6A:
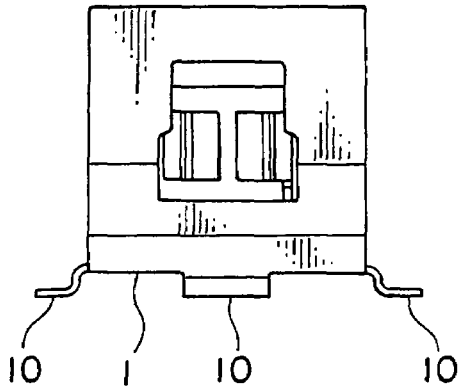
FIG. 6A is a front view of a connector according to a sixth exemplary embodiment of this invention in an opened state.
Figure 6B:
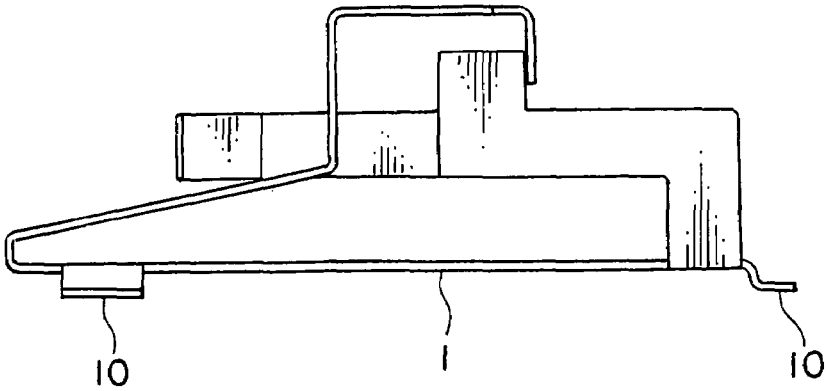
FIG. 6B is a side view of the connector in FIG. 6A in the opened state.

Referring to FIG. 6, description will be made of a connector according to a sixth exemplary embodiment of this invention. Similar parts are designated by like reference numerals and description thereof will be omitted.

In the connector illustrated in FIG. 6, the terminal portions 2 of the connector according to each of the first through the fifth exemplary embodiment are replaced by a pair of substrate connecting portions 10 to be connected to a substrate. The substrate connecting portions 10 are connected to the substrate by soldering. Thus, the connector illustrated in FIG. 6 is of a surface mount type. Although not shown in the figure, the connector may be connected to the substrate via through holes formed in the substrate.

Figure 7A:
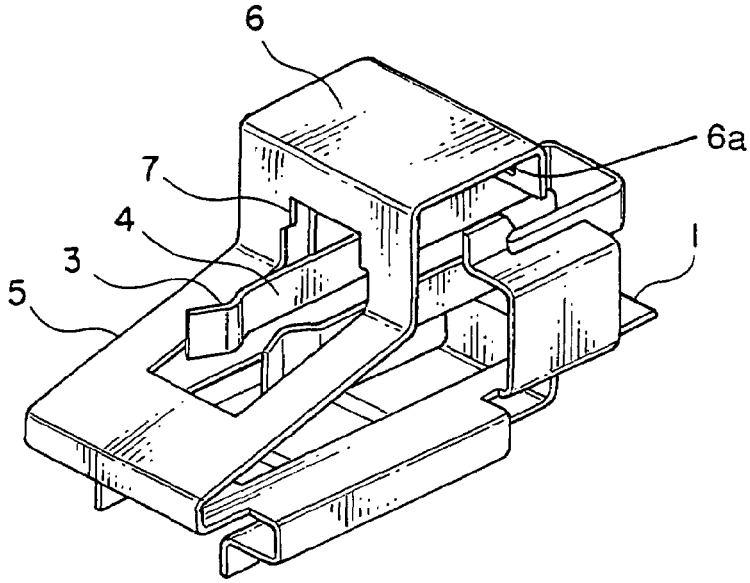
FIG. 7A is a front perspective view of a connector according to a seventh exemplary embodiment of this invention in an opened state.
Figure 7B:
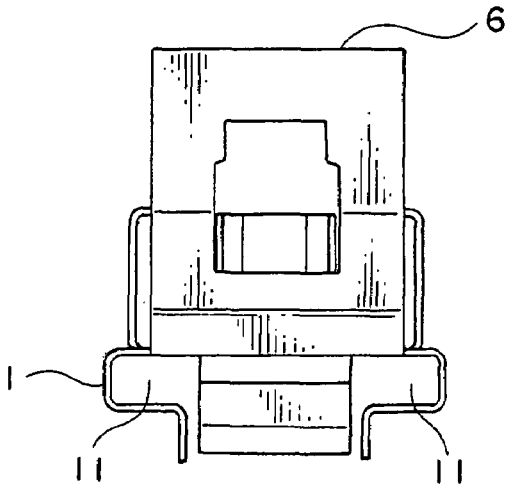
FIG. 7B is a front view of the connector in FIG. 7A in the opened state.
Figure 7C:
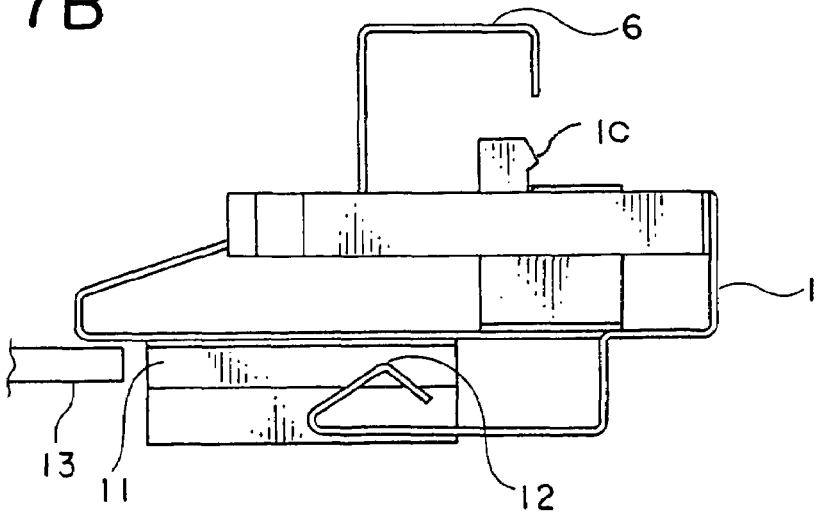
FIG. 7C is a side view of the connector in FIG. 7A in the opened state.

Referring to FIGS. 7A to 7C, description will be made of a connector according to a seventh exemplary embodiment of this invention. Similar parts are designated by like reference numerals and description thereof will be omitted.

The connector illustrated in FIGS. 7A to 7C is substantially similar in structure to the connector illustrated in FIGS. 2A to 2C and is further provided with a substrate inserting portion 11 and a substrate connecting portion 12.

The main body 1 of the connector is provided with the substrate inserting portion 11 having a generally T-shaped section and formed at its lower part. In the substrate inserting portion 11, the substrate connecting portion 12 having a generally triangular shape is arranged to be elastically deformable. When a substrate 13 is inserted into the substrate inserting portion 11, a connection pad (not shown) formed on the substrate 13 is connected to the substrate connecting portion 12. Since the engaged portions (openings) 6*a* are engaged with a pair of locking portions 1*c* of the main body 1, the closed state is maintained.

Figure 8A:
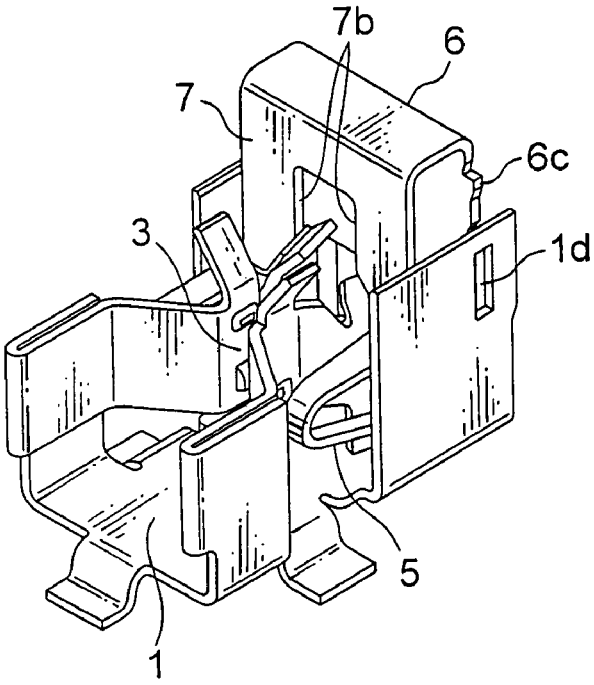
FIG. 8A is a front perspective view of a connector according to an eighth embodiment of this invention in an opened state.
Figure 8B:
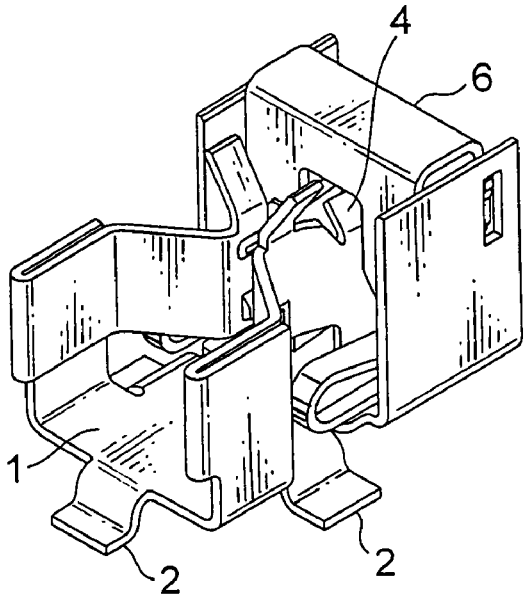
FIG. 8B is a front perspective view of the connector in FIG. 8A in a closed state.
Figure 8C:
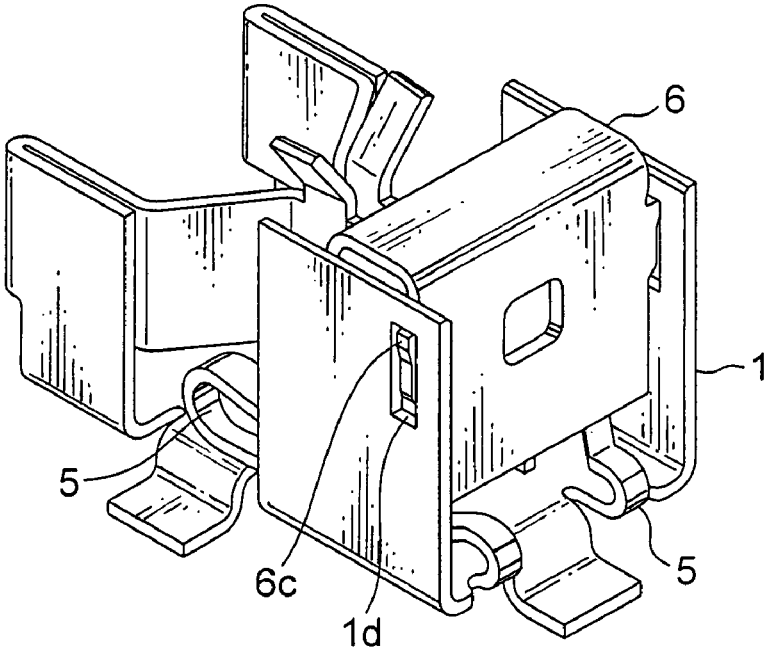
FIG. 8C is a rear perspective view of the connector in FIG. 8A in the closed state.

Referring to FIGS. 8A to 8C, description will be made of a connector according to a seventh exemplary embodiment of this invention. Similar parts are designated by like reference numerals and description thereof will be omitted.

In the connector illustrated in FIGS. 8A to 8C, the main body 1 of the connector has a plurality of terminal portions 2 formed at opposite ends of a lower part thereof and on opposite sides in the vicinity of the center. The terminal portions 2 are adapted to be connected to a substrate or the like. The main body 1 has a pair of contacting portions 3 formed at its lower part and extending from opposite sides at one end towards the center. The contacting portions 3 are adapted to be contacted with the connection object. The contacting portions 3 have the abutting portions 4 formed at their ends, respectively. The main body 1 has a pair of elastic portions 5 formed on opposite sides at the other end and curved in a generally U shape. The elastic portions 5 are connected to the slider portion 6. The slider portion 6 has the operating portion 7. The operating portion 7 has a pair of press-narrowing portions 7*b* formed at the center of its one surface. The press-narrowing portions 7*b* are adapted to clamp and release the abutting portions 4.

The slider portion 6 is provided with a pair of protrusions 6*c* formed on opposite sides thereof and serving as engaged portions. In correspondence to the protrusions 6*c*, a pair of holes 1*d* are formed on opposite side surfaces of the main body 1 in the vicinity of the other end. The holes 1*d* serve as engaging portions.

In the state illustrated in FIG. 8A, the press-narrowing portions 7*b* do not clamp the abutting portions 4 so that the contacting portions 3 are separated from each other. Since the protrusions 6*c* of the slider 6 are not engaged with the holes 1*d* of the main body 1, the contacting portions 3 are kept in the opened state where the connection object is allowed to be inserted. In this state, the connection object is inserted between the contacting portions 3 with zero insertion force or low insertion force. Thereafter, the slider portion 6 is pushed downward. Then, the press-narrowing portions 7*b* clamp the abutting portions 4.

Consequently, as illustrated in FIGS. 8B and 8C, the contacting portions 3 are moved towards each other due to inherent elasticity of the connector. Therefore, the contacting portions 3 are contacted with the connection object so as to clamp the connection object on opposite sides. At this time, each elastic portion 5 is compressed and deformed. Since the protrusions 6*c* of the slider 6 are engaged with the holes 1*d* of the main body 1, the contacting portions 3 are kept in the closed state where the contacting portions 3 are contacted with the connection object.

The foregoing embodiment may be modified in design so that the protrusions 6*c* and the holes 1*d* are formed on the main body 1 and the slider portion 6, respectively. The holes 1*d* may be replaced by recesses or grooves.

Figure 9:
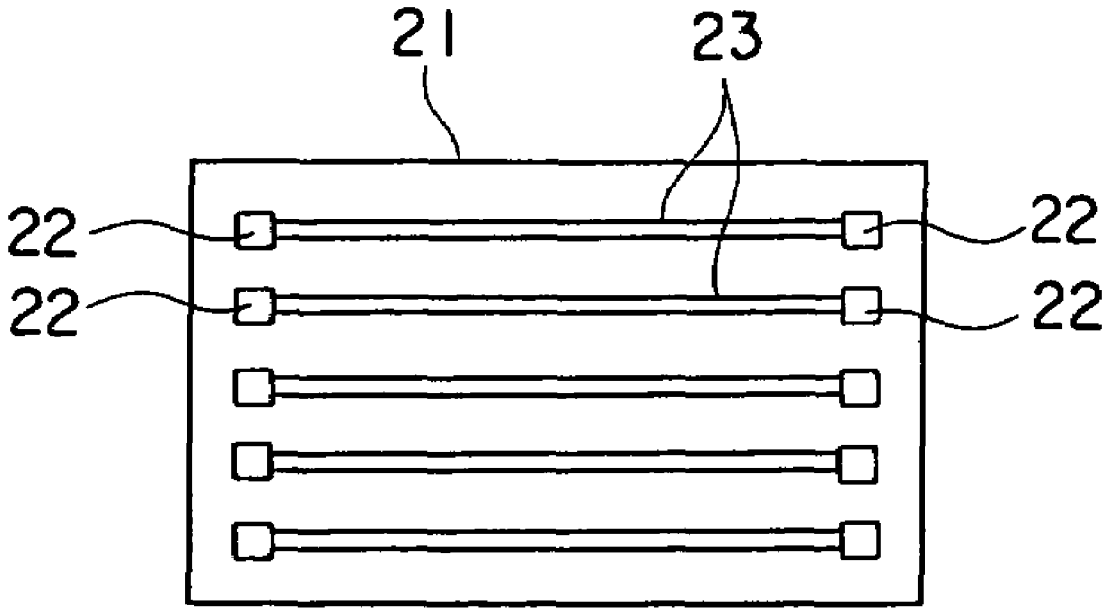
FIG. 9 is a schematic diagram of a backlight assembly using one of the above-mentioned connectors.

Referring to FIG. 9, description will be made of a backlight assembly according to an exemplary embodiment of this invention. Similar parts are designated by like reference numerals and description thereof will be omitted.

The backlight assembly illustrated in FIG. 9 comprises an assembly main body 21, a plurality of connectors 22 fixed to left and right ends of the assembly main body 21, and a plurality of lamp tubes 23 disposed on the assembly main body 21 in parallel to one another and spaced from one another. Each of the lamp tubes 23 has a pair of conductor wires or terminals exposed on its opposite ends. These terminals are connected to the connector 22. Thus, the lamp tube 23 can be supplied with electric power through the connectors 22. When the electric power is supplied, the lamp tube 23 emits light as a matter of course. Therefore, the backlight assembly can be used as a backlight module for a large-scale liquid crystal display. As each connector 22, use may be made of any one of the connectors according to the first through the eighth exemplary embodiments.

Various exemplary embodiments of this invention will be enumerated below.

1. A connector comprising a conductive member adapted to be connected to a connection object 23, the conductive member comprising:

a movable contacting portion 3 to be contacted with the connection object 23; and a position control portion 6 integrally formed with the contacting portion 3 and serving to control a position of the contacting portion 3.

2. The connector according to exemplary embodiment 1, wherein the conductive member comprises:

a main body 1 integrally formed with the contacting portion 3; and an elastic portion 5 coupling the position control portion 6 to the main body 2 so that the position control portion 6 is displaceable with respect to the main body 1.

3. The connector according to exemplary embodiment 2, wherein the main body 1 includes an engaging portion 1*a* for engaging the position control portion 6.

4. The connector according to exemplary embodiment 2, wherein the contacting portion 3 includes an engaging portion 1*a* for engaging the position control portion 6.

5. The connector according to exemplary embodiment 1, wherein the conductive member comprises:

a main body 1 integrally formed with the position control portion 6; and an elastic portion 5 coupling the contacting portion 3 to the main body 1 so that the contacting portion 3 is displaceable with respect to the main body 1.

6. The connector according to exemplary embodiment 5, wherein the contacting portion 3 is kept by the elastic portion 5 at an inoperative position of the position control portion 6.

7. The connector according to exemplary embodiment 6, further including an engaging portion 1*b* for engaging the contacting portion 3 at an operative position of the position control portion 6.

8. The connector according to exemplary embodiment 1, wherein the contacting portion 3 has a pair of contacting surfaces 3*a* faced to each other, the connection object 23 being disposed between the contacting surfaces 3*a*.

9. The connector according to exemplary embodiment 8, wherein the position control portion 6 is operated in a direction of separating the contacting surfaces 3*a* from each other.

10. The connector according to exemplary embodiment 8, wherein the position control portion 6 is operated in a direction of moving the contacting surfaces 3*a* towards each other.

11. The connector according to exemplary embodiment 1, wherein the conductive member further comprises a substrate connecting portion 2, the substrate connecting portion 2 being connected to a substrate 13 by soldering.

12. The connector according to exemplary embodiment 1, wherein the conductive member further comprises a substrate inserting portion 12 and a substrate connecting portion 11, a substrate 13 being inserted into the substrate inserting portion 11 to be connected to the substrate connecting portion 12.

13. A backlight assembly comprising:

an assembly main body 21;

a plurality of connectors 22 according to exemplary embodiment 1 and fixed to opposite ends of the assembly main body 21; and a plurality of lamp tubes 23 disposed on the assembly main body 21 and spaced from one another.

While the invention has been particularly shown and described with reference to various exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connector comprising a conductive member adapted to be connected to a connection object, the conductive member comprising:

a movable contacting portion to be contacted with the connection object;

a position control portion integrally formed with the contacting portion and serving to control a position of the contacting portion;

a main body integrally formed with the contacting portion; and an elastic portion coupling the position control portion to the main body so that the position control portion is displaceable with respect to the main body.

2. The connector according to claim 1, wherein the main body includes an engaging portion for engaging the position control portion.

3. The connector according to claim 1, wherein the contacting portion includes an engaging portion for engaging the position control portion.

4. A connector comprising a conductive member adapted to the connected to a connection object, the conductive member comprising:

a movable contacting portion to be contacted with the connection object;

a position control portion integrally formed with the contacting portion and serving to control a position of the contacting portion;

a main body integrally formed with the position control portion;

an elastic portion coupling the contact portion to the main body so that the contacting portion is displaceable with respect to the main body and wherein the contacting portion is kept by the elastic portion at an inoperative position of the position control portion; and an engaging portion for engaging the contacting portion at an operative position of the position control portion.

5. A connector comprising a conductive member adapted to be connected to a connection object, the conductive member comprising:

a movable contacting portion to be contacted with the connection object, wherein the contacting portion has a pair of contacting surfaces faced to each other and the connection object is disposed between the contacting surfaces; and a position control portion integrally formed with the contacting portion and serving to control a position of the contacting portion, wherein the position control portion is operated in a direction of moving the contacting surfaces towards each other.

6. A connector comprising a conductive member adapted to be connected to a connection object, the conductive member comprising:

a movable contacting portion to be contacted with the connection object;

a position control portion integrally formed with the contacting portion and serving to control a position of the contacting portion; and a substrate connecting portion, the substrate connecting portion being connected to a substrate by soldering.

7. A connector comprising a conductive member adapted to be connected to a connection object, the conductive member comprising:

a movable contacting portion to be contacted with the connection object;

a position control portion integrally formed with the contacting portion and serving to control a position of the contacting portion; and a substrate inserting portion and a substrate connecting portion, a substrate being inserted into the substrate inserting portion to be connected to the substrate connecting portion.

* * * * *